US009850679B2

(12) United States Patent
Waters

(10) Patent No.: US 9,850,679 B2
(45) **Date of Patent: *Dec. 26, 2017**

(54) MARINE VESSEL CANOPY

(71) Applicant: Eyal Waters, Fort Lauderdale, FL (US)

(72) Inventor: Eyal Waters, Fort Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/482,595

(22) Filed: Apr. 7, 2017

(65) Prior Publication Data

US 2017/0211292 A1 Jul. 27, 2017

Related U.S. Application Data

(63) Continuation-in-part of application No. PCT/US2016/045985, filed on Aug. 8, 2016, which is a continuation of application No. 14/820,153, filed on Aug. 6, 2015, now Pat. No. 9,586,653.

(51) Int. Cl.

| | |
|---|---|
| ***B63B 17/02*** | (2006.01) |
| ***E04H 15/06*** | (2006.01) |
| ***E04H 15/40*** | (2006.01) |
| ***E04H 15/44*** | (2006.01) |
| ***E04H 15/32*** | (2006.01) |
| ***E04H 15/54*** | (2006.01) |
| *E04H 15/58* | (2006.01) |

(52) U.S. Cl.

CPC ..... *E04H 15/06* (2013.01); *B63B 17/02* (2013.01); *E04H 15/32* (2013.01); *E04H 15/40* (2013.01); *E04H 15/44* (2013.01); *E04H 15/54* (2013.01); *E04H 15/58* (2013.01)

(58) Field of Classification Search

None

See application file for complete search history.

(56) References Cited

U.S. PATENT DOCUMENTS

| | | | | |
|---|---|---|---|---|
| 2,864,391 | A | 12/1958 | Stark | |
| 2,889,839 | A | 6/1959 | Sheridan, Jr. | |
| 3,604,440 | A | 9/1971 | Wilson | |
| 3,896,832 | A | 7/1975 | Montoya | |
| 4,300,253 | A | 11/1981 | Anderson | |
| 5,944,039 | A | 8/1999 | Bergeron | |
| 6,725,871 | B1 | 4/2004 | Shearer et al. | |
| 8,950,416 | B1 | 2/2015 | Spellman | |
| 9,586,653 | B2 * | 3/2017 | Waters | B63B 17/02 |
| 2015/0000586 | A1 | 1/2015 | Vargo et al. | |

* cited by examiner

*Primary Examiner* — Edwin Swinehart

(74) *Attorney, Agent, or Firm* — Johnson | Dalal; Mark C. Johnson

(57) ABSTRACT

A canopy assembly for a marine vessel having at least one U-shaped canopy support member each removably coupled to a first side section and a second side section of a marine vessel, a cover coupled to the at least two U-shaped canopy support members, with an upper surface providing a water barrier to, and in an overlapping relationship with, an upper surface of a bow of the marine vessel, spanning from the first and second ends of each of the at least one U-shaped canopy support member, and having a cover zipper assembly with a plurality of teeth. The assembly also includes a track zipper assembly having a plurality of teeth removably interlocked with the plurality of teeth of the cover zipper assembly to form a joint contouring a portion of the marine vessel that includes the first and second side sections and the fore section of the marine vessel.

19 Claims, 16 Drawing Sheets

MARINE VESSEL CANOPY

FIELD OF THE INVENTION

The present invention relates generally to marine vessel coverings and, more particularly, relates to a covering for a marine vessel that is removable.

BACKGROUND OF THE INVENTION

A significant portion of the public utilizes marine vessels or other vessels to navigate through bodies of water. It is well known that when doing so, users on those vessels become exposed to solar radiation and other environmental elements. To reduce said exposure, various known methods and devices have been developed to cover users and the vessel itself from said exposure.

Some known marine vessel coverings are designed to cover the entire boat, i.e., for storing, which make them impossible for users to use and enjoy the boat. Those known coverings that do attempt to permit use of the boat also fail to provide effective and efficiency use of the same. Some known covers are permanently installed on the marine vessel, thereby making it difficult to remove and enjoy the open space of the boat if desirable. Furthermore, many of those permanently installed structures decrease user-visibility and aerodynamic properties, providing an unsafe or inefficient design.

Many coverings that are temporary or removable still suffer from many of those disadvantages associated with permanently installed structures, and also require the arduous task of removing the covering from the boat. Specifically, many of these temporary coverings involve unhooking ties of the coverings from various hooks on the boat or unscrewing bolts, screws, or other fasteners from the covering structure and the boat. Further, many of those known removable vessel coverings are substantially rigid and often difficult to both handle and store when they are removed.

Some other known removable coverings are designed to only act as a shade when the boat is in a static state, i.e., not moving. These coverings are very impractical due to the set-up and removal time and because it does not solve the environment element exposure to the user when the vessel is moving, i.e., in a dynamic state. Other known temporary coverings are designed to simply snap onto a corresponding fastener installed on the boat structure, and while they may be relatively easy to remove and store, they are not very easily installed and do not provide adequate space for users that desire to be under the covering. Further, coverings that snap also are not designed to resist forces created while the boat is in the dynamic state. Lastly, these coverings that snap into place also leave portions of the snaps or other fastening means exposed to the viewing public and, when the covering is installed, leaves conspicuous tracks/fasteners, which many users find undesirable.

Therefore, a need exists to overcome the problems with the prior art as discussed above.

SUMMARY OF THE INVENTION

The invention provides a marine vessel covering that overcomes the hereinafore-mentioned disadvantages of the heretofore-known devices and methods of this general type and that is both efficient in time to install and remove, in addition to providing the user the ability to have enough space under the covering and provide protection from undesired exposure to environmental elements when the vessel is in the dynamic state.

With the foregoing and other objects in view, there is provided, in accordance with the invention, and in combination with a marine vessel having a bow with a first side section and a second side section opposing the first side section, a fore section interposing a first and second side sections of the bow, and an upper surface, an improvement that includes a canopy assembly with (1) at least two U-shaped canopy support members each with a first end removably coupled to the first side section of the marine vessel and a second end removably coupled to the second side section of the marine vessel, (2) a cover coupled to the at least two U-shaped canopy support members, with an upper surface providing a water barrier to, and in an overlapping relationship with, the upper surface of the bow of the marine vessel, that spans from the first and second ends of each of the at least two U-shaped canopy support members, and having a cover zipper assembly with a plurality of teeth, and (3) a track zipper assembly mechanically coupled to the first and second side sections and the fore section of the marine vessel, wherein the track zipper assembly having a plurality of teeth removably interlocked with the plurality of teeth of the cover zipper assembly to form a joint that contours a portion of the marine vessel that includes the first and second side sections and the fore section of the marine vessel.

In accordance with a further feature of the present invention, the plurality of teeth of the track zipper assembly are operably configured to be removably interlocked with the plurality of teeth of the cover zipper assembly in single substantially uninterrupted motion.

In accordance with another feature, an embodiment of the present invention includes at least one canopy strap with a proximal end coupled to the cover of the canopy assembly, the at least one canopy strap having an installed position with a distal end coupled to the marine vessel to place the upper surface in a taut position.

In accordance with a further feature, an embodiment of the present invention also includes a plurality of canopy support posts mechanically coupled to the first and second side sections of the marine vessel and sized to at least one of be received by and receive at least one of the first end and the second end of the at least two U-shaped canopy support members.

In accordance with a further feature of the present invention, the plurality of canopy support posts retaining the at least one of the first end and the second end of the at least two U-shaped canopy support members without use of fasteners.

In accordance with an additional feature of the present invention, the plurality of canopy support posts are operably configured to restrict lateral movement of the at least one of the first end and the second end of the at least two U-shaped canopy support members when the plurality of canopy support posts are at least one of received by and receive the at least one of the first end and the second end of the at least two U-shaped canopy support members.

In accordance with a further feature, an embodiment of the present invention also includes the at least two U-shaped canopy support members each having a cross bar removably coupleable to a first leg having the first end and to a second leg having the second end. The cross bar may also be arcuate.

In accordance with an additional feature, an embodiment of the present invention includes the first and second ends of each of the at least two U-shaped canopy support members having a canopy support member width, wherein the at least two U-shaped canopy support members are of a flexibly resilient material to increase the canopy support member width, when placed in a flexed state, by 10-25%.

In accordance with yet another feature, an embodiment of the present invention includes a flap portion sized and configured to overlap the joint, leaving the joint not visible from an outside ambient environment.

In accordance with the present invention, a marine vessel canopy assembly is disclosed that includes (1) at least one U-shaped canopy support members, each having a horizontal cross bar with two opposing ends each with a leg extending substantially perpendicular thereto, the leg including a distal end defining a leg aperture, (2) a cover having a distal end, a proximal end, a substantially watertight upper surface, and a bottom surface with a plurality of loops defining apertures sized to receive at least one of the at least two U-shaped canopy support members, the cover including a cover zipper assembly with a plurality of teeth, (3) a track zipper assembly having a plurality of teeth operably configured to removably interlock with the plurality of teeth of the cover zipper assembly to form a U-shaped joint, (4) a plurality of canopy support posts sized to be received by the leg aperture of the at least two U-shaped canopy support members, and (5) at least one canopy strap with a proximal end coupled to the cover and disposed between the two opposing ends of the horizontal cross bar of the at least two U-shaped canopy support members, the at least one canopy strap extending in a direction away from the distal end of the cover and having a distal end defining an aperture sized to receive a fastener.

In accordance with a further feature of the present invention, the plurality of canopy support posts are operably configured to restrict lateral movement of the distal end of the at least two U-shaped canopy support members.

In accordance with yet another feature of the present invention, the horizontal cross bar of the at least two U-shaped canopy support members is removably coupleable to the legs attached thereto.

In accordance with yet another feature, an embodiment of the present invention includes the upper surface of the cover having a flap portion sized and configured to overlap the U-shaped joint, leaving the U-shaped joint not visible from an outside ambient environment.

Although the invention is illustrated and described herein as embodied in a marine vessel covering, it is, nevertheless, not intended to be limited to the details shown because various modifications and structural changes may be made therein without departing from the spirit of the invention and within the scope and range of equivalents of the claims. For example, use of the term "marine" does not necessarily limit the use of the present invention to vessels employed to navigate through seas, as its application may be to any vessel used to navigate through any body of water. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the marine vessel to which the canopy may be attached.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
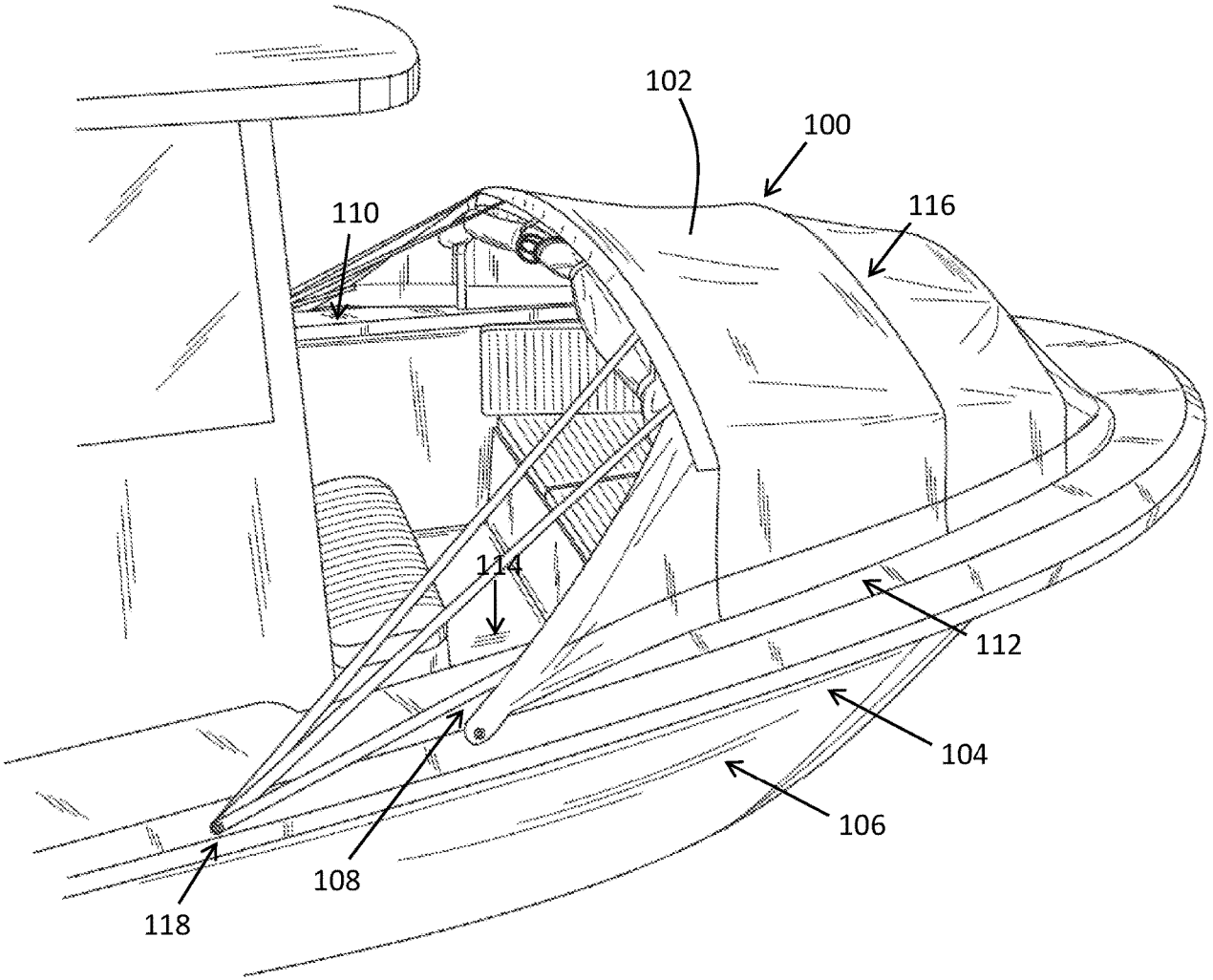
FIG. 1 is a fragmentary perspective, right-side, view of a marine vessel with a removable canopy assembly attached thereto in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and effective marine vessel canopy that shields inhabitants or users of a marine vessel from environmental elements that are potentially harmful and can resist uplift and other forces generated by wind when the vessel is in a dynamic state. Further, the canopy is operable to be removed quickly and efficiency with minimal user involvement and in little time.

Figure 2:
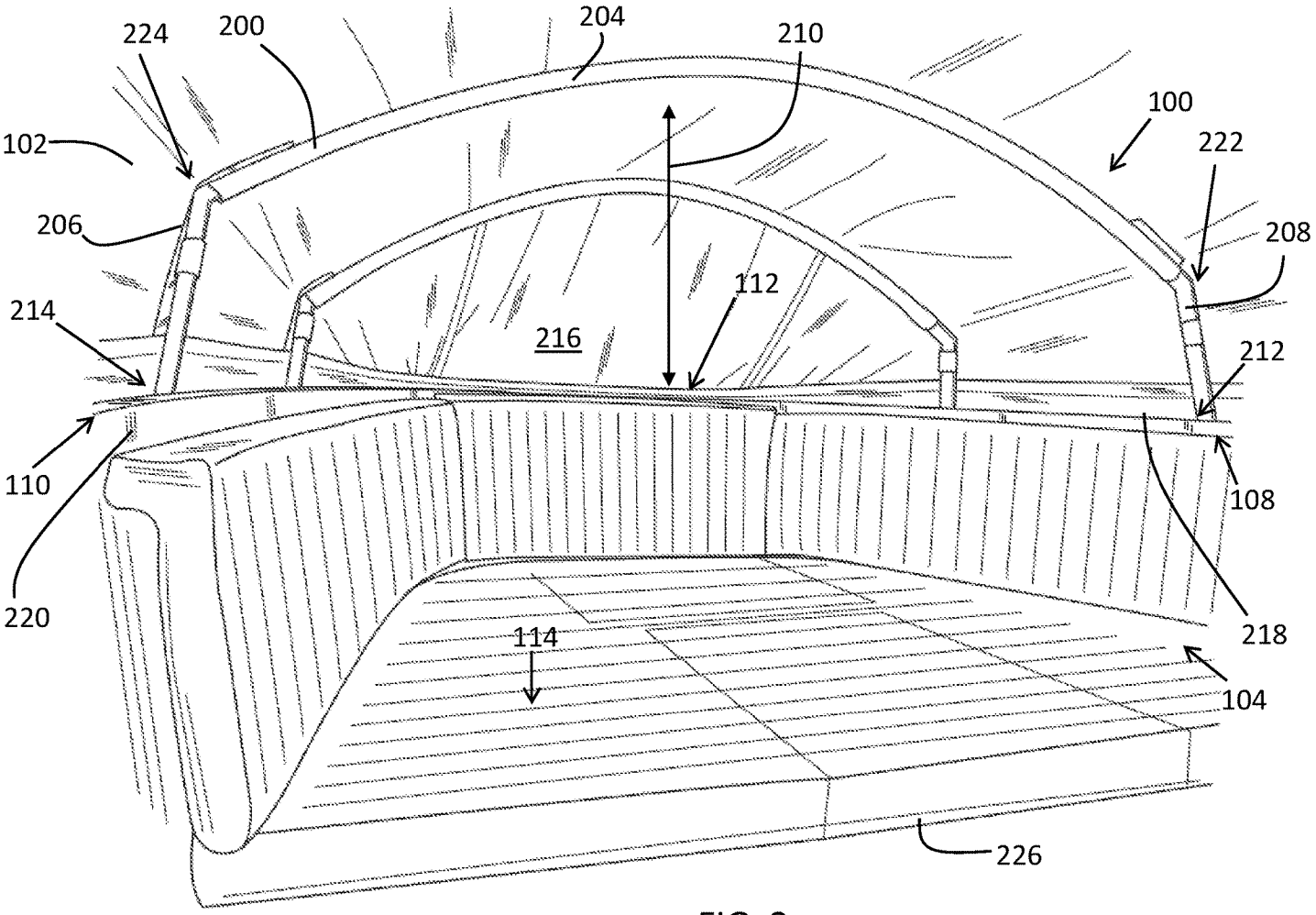
FIG. 2 is an elevational rear view of the removable canopy assembly attached to the vessel in accordance with the present invention.
Figure 3:
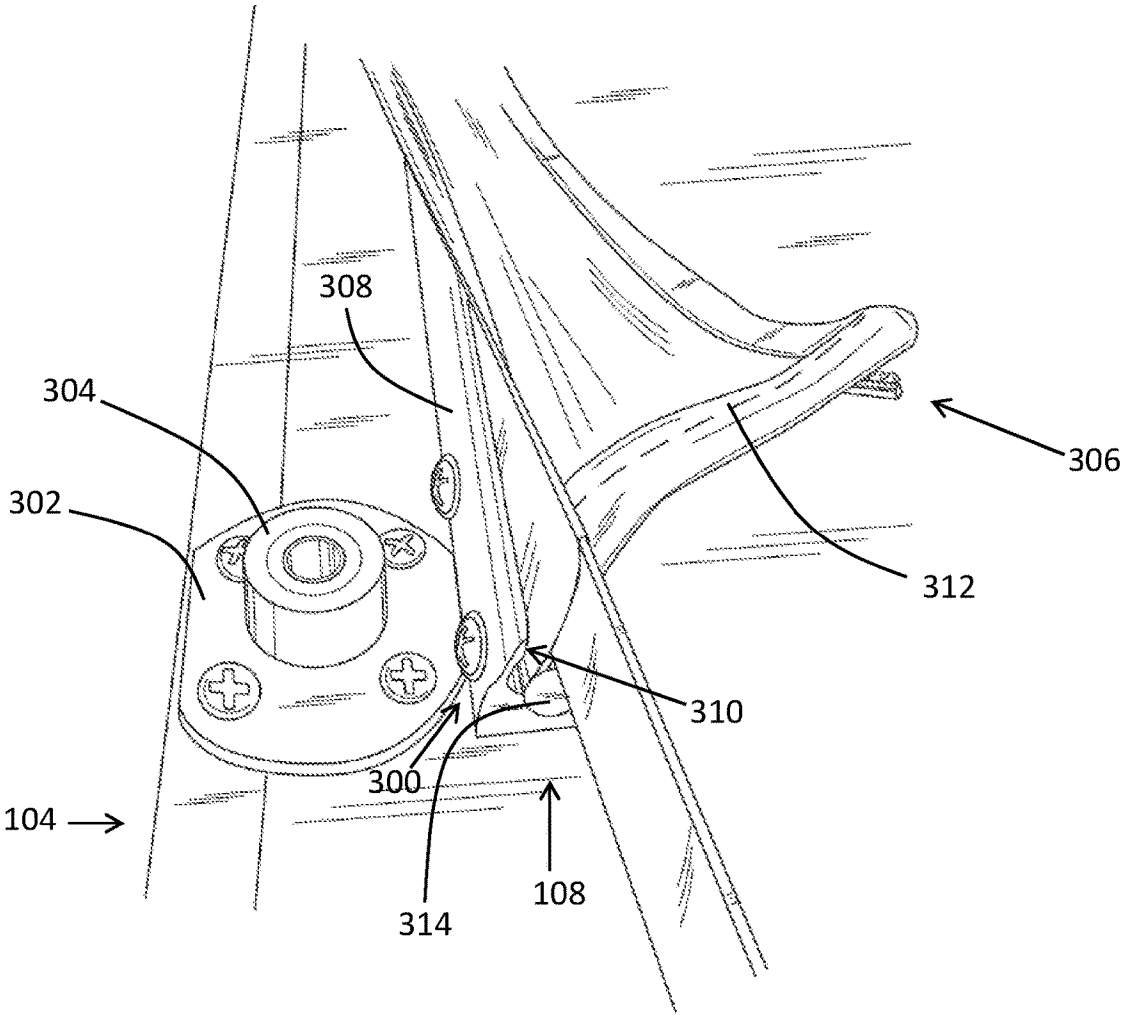
FIG. 3 is a partial, close-up, view of a track zipper assembly and a canopy support post in accordance with one embodiment of the present invention.

Referring now to FIGS. 1-3, one embodiment of the present invention is shown in a perspective view and elevational view, respectively. FIGS. 1-3 show several advantageous features of the present invention, but, as will be described below, the invention can be provided in several shapes, sizes, combinations of features and components, and varying numbers and functions of the components. The first example of a marine vessel canopy assembly 100, as shown in FIGS. 1-3, includes one or more canopy support members 200, a cover 102, and a track assembly 300. Advantageously, the canopy 100 is shown coupled to the bow 106, or forward part, of the marine vessel 104. As discussed below, the track assembly 300 beneficially permits the cover 102 and/or the support members 200, to be removed and installed more efficiently and effectively than those known coverings.

As known by those of skill in the art, a vessel 104 may include a first side section 108, a second side section 110 opposing the first side section 108, a fore section 112 interposing the first and second side sections 108, 110 of the bow 106, and an upper surface 114, i.e., the outer surface or "upper deck" of the bow 106 disposed for contact by the user when the user is within the vessel 104. The fore section 112 section of the bow 106 is the portion where the width (represented by arrow 400 in FIG. 4) of the hull is tapered.

To provide sufficient space for the vessel users, the canopy assembly 100 includes one or more canopy support members 200 generally of a "U" shape as shown in FIG. 2. In one embodiment, there are at least two canopy support members 200 to minimize use of material and ensure there are at least two support points that support the weight of the cover 102 and facilitate in providing structural integrity to the assembly 100 when the vessel is in its dynamic state. In other embodiments, as shown in FIG. 1, there are three or more support members 200, or there may be a single support member with a length that spans a portion of the length of the fore section 112. The canopy support member 200 may also form a "V" shape without deviating from the general "U" shape depicted in FIG. 2. Said differently, the shape of the canopy support member 200 has at least one inflection point. In preferred embodiments, the canopy support member 200 includes a portion that is arcuate to provide minimal resistance to wind and other elements and to facilitate in accommodating various sized widths of hulls.

The canopy support members 200 may be of a single unitary piece that is cast or injection molded, or may be formed from a plurality of pieces. In one example, the canopy support member 200 may include a cross-bar section 204 that is removably coupleable to a first leg 206 and a second leg 208 for ease of storage. As depicted in FIG. 2, the legs 206, 208 may have a portion substantially perpendicular, e.g., approximately 75-105°, to two opposing ends 222, 224 of the cross bar 204. The cross-bar section 204 may be removably coupleable to the legs 206, 208 through one or more fasteners, one or more spring-loaded notches shaped and sized to be inserted in corresponding apertures, or through particular sized-diameters of the canopy support members 200. In further embodiments, the height of the canopy 100 (represented with arrow 210 in FIG. 2) may be adjusted through the displacement of the legs 206, 208 in relation to the cross bar 204 via, e.g., the one or more spring-loaded notches described above. The height adjustment advantageously provides users the ability to reduce or increase the height of the canopy for comfort of the users within and for vessel operator visibility purposes.

In one embodiment, the canopy support members 200 are of a flexibly resilient material to increase the canopy support member width (represented with arrow 402 in FIG. 4), when placed in a flexed state, by 10-25%. Said differently, the material of the canopy support members 200 is capable of bending from its static state, i.e., unexposed to an external force, approximately by 10-25% without breaking, yet be capable of returning to its static state without any plastic deformation. In one embodiment, the canopy support member 200 is a hollowed cylinder or tube of a polyvinyl chloride material, of approximately a schedule 40 diameter. In other embodiments, the canopy support members 200 may be of a thin-walled metallic material such as aluminum, fiberglass, carbon fiber, or any other metallic, polymeric, or composite material. The flexibility of the support members 200 provides users the ability to accommodate various size widths of a hull. Additionally, the flexibility also provides distributors and resellers the ability to accommodate more vessels without employing the time- and cost-intensive task of creating a template.

Figure 5:
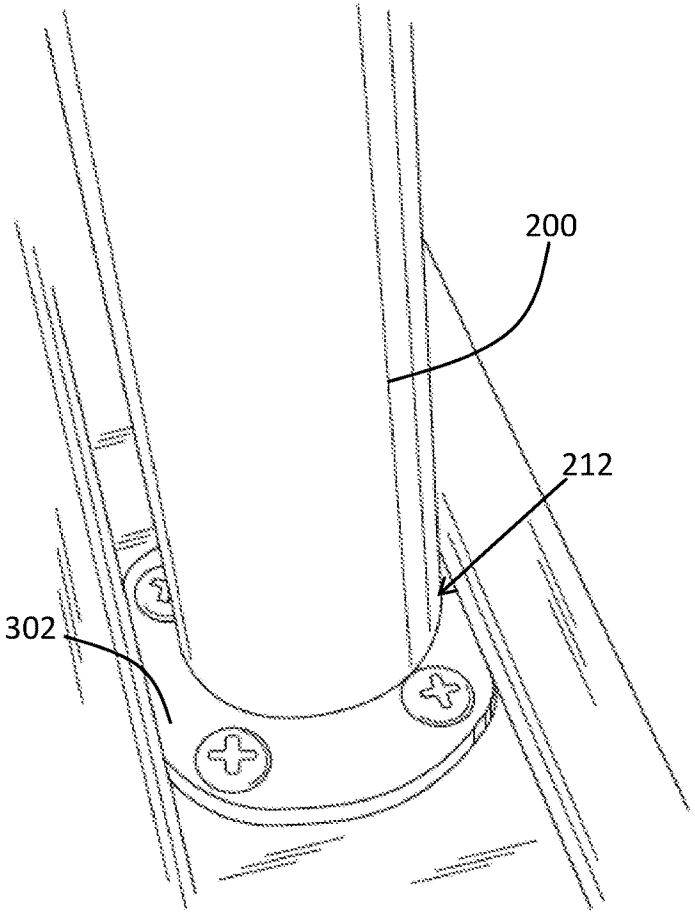
FIG. 5 is a partial, close-up, view of a canopy support member coupled to the canopy support post of FIG. 3 in accordance with one embodiment of the present invention.

With reference briefly to FIGS. 2, 3 and 5, the canopy support members 200 can be seen having a first end 212 removably coupled to the first side section 108, e.g., "starboard," of the marine vessel 104 and a second end 214 removably coupled to the second side section 110, e.g., "port side," of the marine vessel 104. In one embodiment, using the first side section 108 of the vessel 104 as an example in FIGS. 3 and 5, the canopy assembly 100 includes a plurality of canopy support posts, e.g., post 302, that are mechanically coupled, e.g., through one or more fasteners or adhesive, to the first and second side sections 108, 110 of the marine vessel 104. The posts 302 may be sized to either be received by either the first or second ends 212, 214 of the canopy support members 200 or to receive the same. Said another way, the posts 302 may have one or more apertures (also referred to herein as "leg aperture(s)"), or vice versa with respect to the ends 212, 214, associated therewith to allow the ends 212, 214, or vice versa with respect to the posts 302, to be received.

As shown in FIGS. 2, 3 and 5, the first and second ends 212, 214 include an aperture sized to receive a male portion 304 of the post 302. In preferred embodiments, the male portion 304 of one or more posts 302 is sized to be inserted approximately 0.5-3" inside of the respective ends 212, 214 so as to facilitate a quick and effective removal and retention not accomplished with the prior art coverings. As such, the plurality of canopy support posts 302 may be operable to retain either the first or second ends 212, 214 of the canopy support member 200 without the use of fasteners, e.g., bolts, screws, adhesives. In said manner, when the track assembly 300 is uncoupled to a track assembly of the cover, both the cover 102 and/or the support members 200 can be removed quickly and easily. The plurality of canopy support posts 302 may also be operable to restrict lateral, i.e., side-to-side, movement of the first and second ends 212, 214 when coupled thereto. Therefore, the assembly 100 is operable to resist extreme wind forces generated by the vessel when in a dynamic state.

Figure 6:
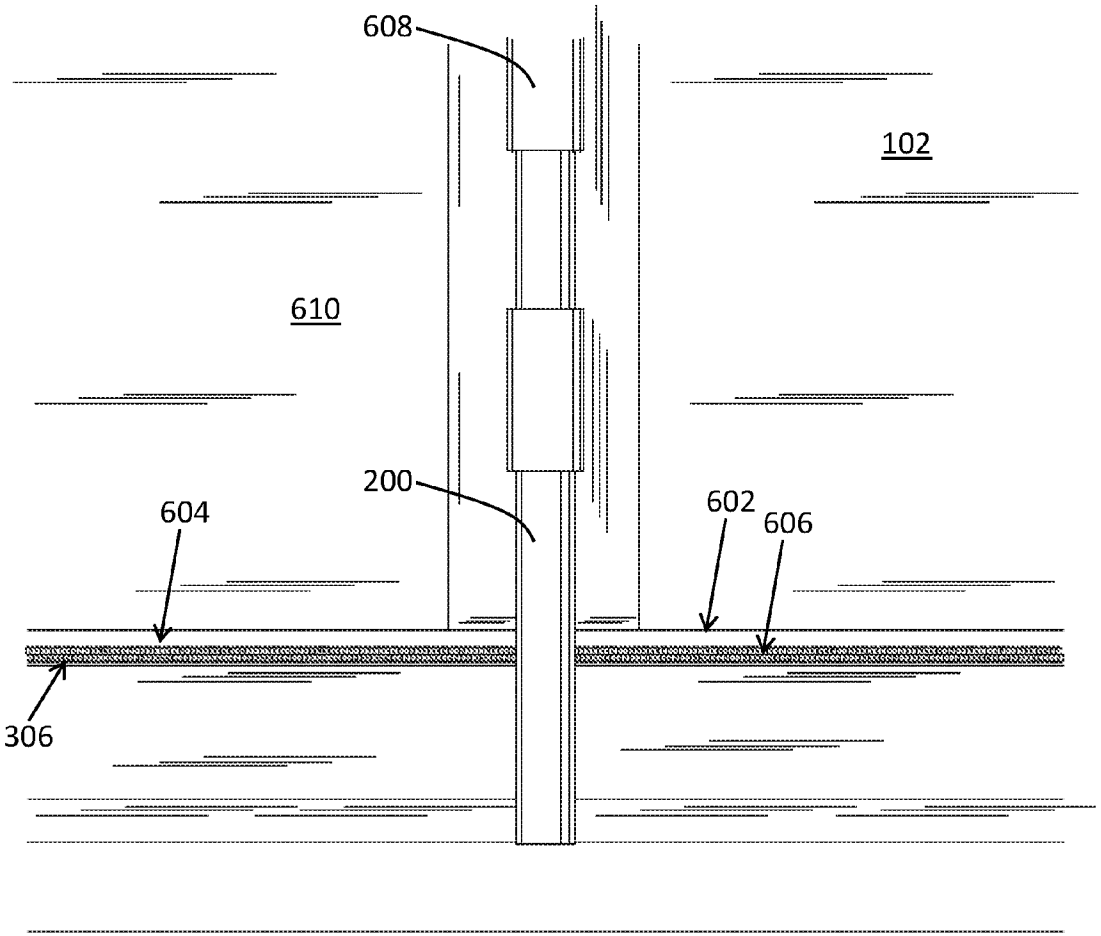
FIG. 6 is an elevational view of a cover zipper assembly on the cover of the canopy assembly coupled to the track zipper assembly of FIG. 3 in accordance with one embodiment of the present invention.

With reference now to FIGS. 1, 2 and 6, the cover 102 can be seen coupled to one or more canopy support members 200. The cover 102 can be seen having an upper surface 116 that provides a water barrier to, and is in an overlapping relationship with, the upper surface 114 of the bow 106 of the marine vessel 104. The cover 102 can also be seen spanning from the first and second ends 212, 214 of each of the canopy support members 200. Said another way, the cover 102 creates a substantially watertight barrier, excluding apertures or slits in the removable window portion 404 (operably to be removably coupled to the cover 102 with Velcro) or the joint 606, to the volume (represented with numeral 216 in FIG. 2) defined by the cover 102 and the upper surface 114. The cover 102 may cover the entire upper surface 114 and may span from the first side section 108, through an ultimate, penultimate, or other distal position at the fore section 112, and terminate at the second side section 214. Said even further, the cover 102 can be said to enclose the upper surface 114 until it at least reaches the walls 218, 220 defining the first and second side sections 212, 214. The cover 102 may be of a water resistant and durable material such as, for example, a paraffin-coated canvas material, nylon, vinyl, or polyester, among others. The window 404 may be of a transparent/translucent material, or may be formed with a plurality of apertures, to increase overall user visibility while operating the vessel.

The cover 102 can be seen coupled to one or more canopy support members 200 through one or more fasteners, such as screws, bolts, and/or adhesives. Advantageously, in some embodiments, the cover 102 may be coupled to the one or more canopy support members 200 using a strap having hook-and-loop fasteners, such as Velcro, or a zipper assembly. This enables users to separate the cover 102 from the support members 200 for cleaning and/or storing. The cover 102 may also include loops, e.g., loop 608, or other structures defined by a bottom surface 610 of the cover 102 used to guide the support members 200 into a configuration where the cover 102 is retained thereto. In one embodiment, the loop 608 is sized to receive the diameter or width of the canopy support members 200.

Figure 4:
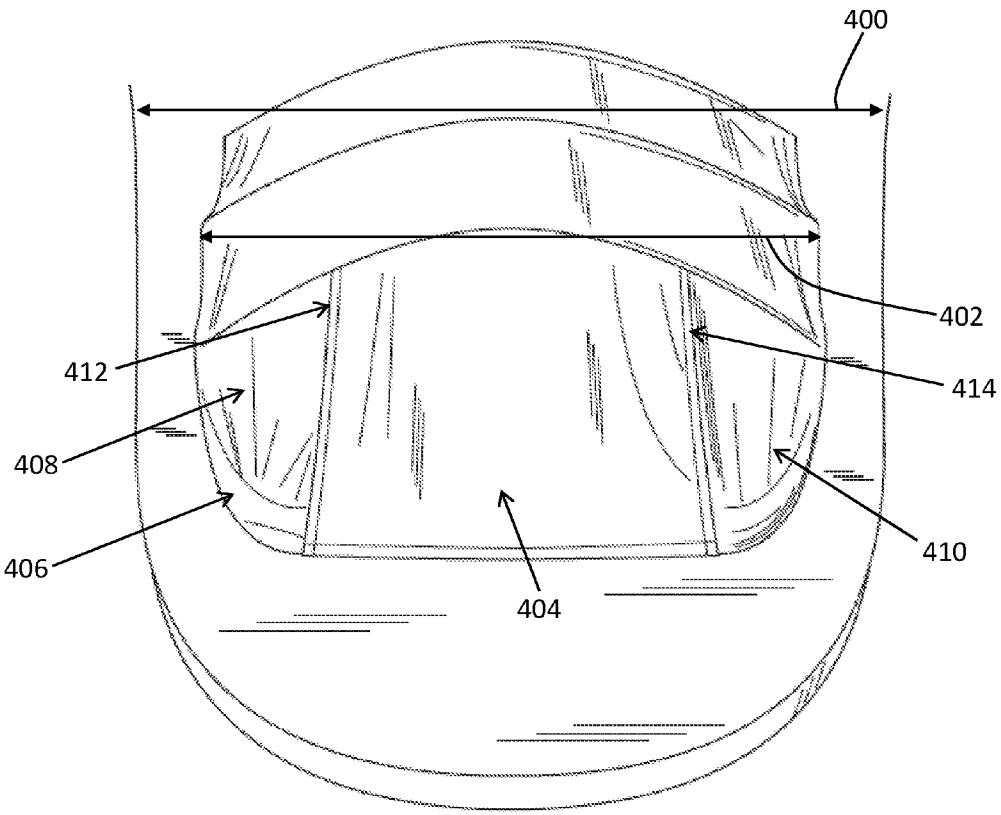
FIG. 4 is a perspective, downward-looking, front view of the removable canopy assembly attached to the vessel in accordance with the present invention.

With reference specifically to FIGS. 2, 3, and 6, the cover 102 can also be seen having a cover zipper assembly 602 that includes a plurality of teeth 604 that is operably configured to removably interlocked with a plurality of teeth 306 on the track zipper assembly 300 to form a joint 606 (as shown in FIG. 6). Beneficially, the joint 606 formed by the interlocking of the teeth 306, 604 contours a portion of the marine vessel 104 that includes the first and second side sections 108, 110 and the fore section 112. Said another way, the joint 606 follows the form or curve of the bow of the marine vessel, as depicted in FIGS. 1 and 4. The joint 606 may also be formed by two or more zipper sections 300, 602 that are not necessarily connected. Said another way, one joint section may be formed by the zipper assemblies 300, 602 beginning on the side section 108 and terminates at the fore section 712 (shown in FIG. 7), while another joint section may be formed by the zipper assemblies 300, 602 beginning on the side section 108 and also terminates at the fore section 712. The joint 606 formed by the two zipper assemblies 300, 602 may also be described as creating a general "U-shape," as discussed above. The U-shape of the joint 606 facilitates in ensuring the proper area of the marine vessel 104 is at least partially surrounded.

In one embodiment, the joint 606 is located within a range of approximately 1-8" from the upper surface 114 of the walls 218, 220 defining the side sections 108, 110 so as to minimize excess material exposure when the cover 102 unzipped from the track zipper assembly 300. Advantageously, the plurality of teeth 306 of the track zipper assembly 300 is operably configured to be removably interlocked with the plurality of teeth 604 of the cover zipper assembly 602 assembly in single substantially uninterrupted motion by zipping/unzipping the cover 102 thereto. Said another way, the cover 102 may be zipped/coupled to the track zipper assembly 300 in one motion, excluding any pauses by the user to maneuver around the support members 200. In one embodiment, where the support members 200 may be embedded or encapsulated in the cover 102, the user would be able to unzip the cover 102 from the track zipper assembly 300 in a single, uninterrupted, motion.

With reference specifically to FIG. 3, the track zipper assembly 300 can be seen mechanically coupled, e.g., with screws, bolts, adhesive, to the upper surface 114 of the side sections 108, 110 and the fore section 112, so as to ensure the cover 102 at least partially surrounds a portion of the bow 106 of the vessel 104. The track zipper assembly 300 may include a rail 308 defining a recess 310 shaped to receive a rope 314, cable, or other material attached to a zipper extension 312 coupled to the teeth 306. In one embodiment the zipper extension 312 may be made of the same material of the cover 102, while in other embodiments, it may be made of a different material. The rail 308 may be made with metallic, plastic, composite, or other material sufficient withstand typical uplift forces generated by the wind generate over the cover 102 when in its installed position. The rope 314 may be a fabric, metallic, or other material that may be encapsulated by the zipper extension 312 and fastened within the recess 310. In other embodiments, the zipper assembly 300 may be formed as one piece of material.

Figure 7:
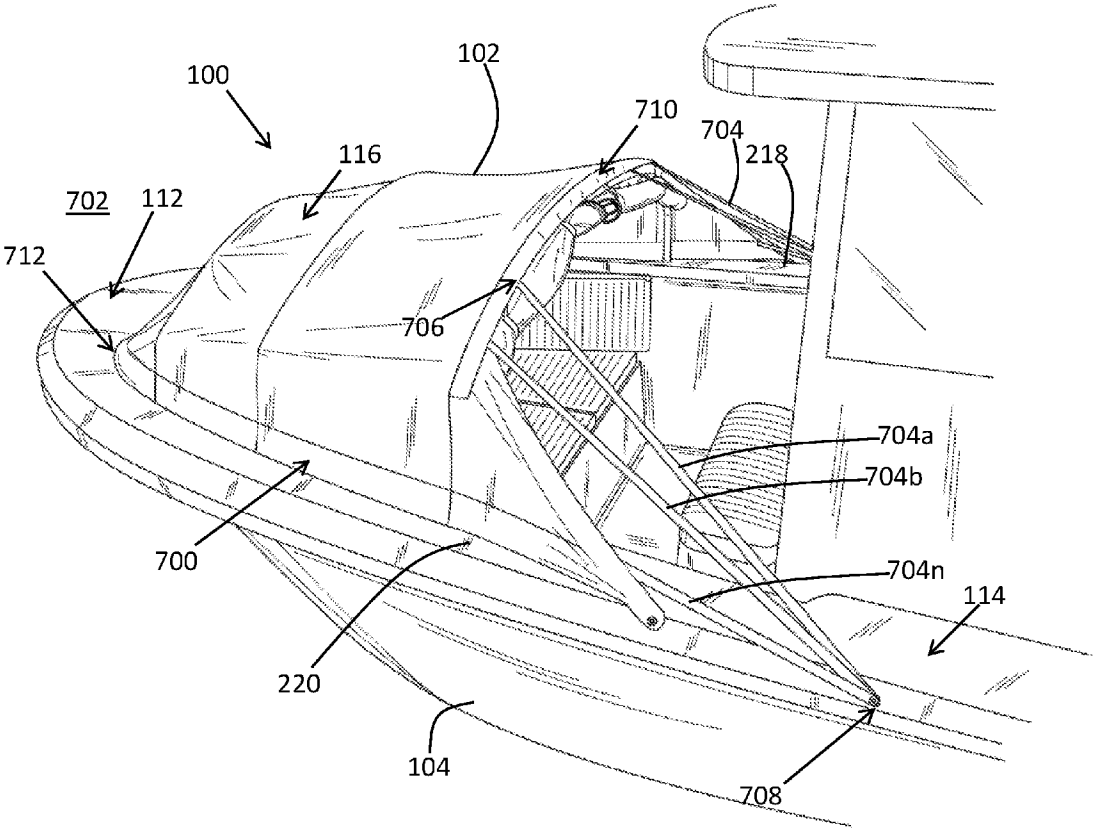
FIG. 7 is a fragmentary perspective, left-side, view of the marine vessel and canopy assembly in FIG. 1.

With reference now to FIGS. 6-7, the cover 102 be seen having a flap portion 700 sized and configured to overlap the joint 606. As such, the flap portion 700 leaves the joint 606 not visible from an outside ambient environment 702, as depicted in FIG. 7. Preferably, the flap portion 700 is an excess portion, of an approximate length of 2", of the cover 102 material that extends passed the joint 606 and reaches the upper surface 114 of the side walls 218, 220. The flap portion not only reduces air resistance by deflecting oncoming wind, but it also inhibits the influx of water and other fluids into the interior volume 216 (shown in FIG. 2) whether the vessel 104 is in the static or dynamic position.

Referring now to FIG. 7, the cover 102 can be seen having one or more canopy straps 704*a-n*, wherein "n" represents an amount greater than one. Taking strap 704*a* as an example, the strap(s) 704*a* can be seen having a proximal end 706 coupled to the cover 102 and a distal end 708. The canopy straps 704 may have an uninstalled position wherein the distal end 708 is not attached to any structure and an installed position with the distal end 708 coupled to the marine vessel 104 to place the upper surface 116 of the cover in a taut position, i.e., stretched or pulled tight in the longitudinal direction of the cover. The canopy straps 704 provide an important and beneficial feature of the present invention in light of the possible high speeds experienced by some marine vessels and the attachment of the canopy assembly 100 to the marine vessel 104.

More specifically, as the ends 212, 214 of the support members 200 are not permanently fastened to the posts 302 (as discussed above in reference to FIGS. 3 and 5), the cover 102 is fastened to the marine vessel 104 through the zipper assemblies 300, 602. This attachment provides sufficient resistance to uplift and other forces subject to the cover 102, both in the traverse and longitudinal orientations of the cover 102, as the track zipper assembly 300 spans around the side and fore sections of the vessel. To reduce vibration and ensure retention and stability of the cover 102 to the vessel 104 while the vessel is traveling at high speeds, the canopy straps 704*a-n* provide tensional forces on the cover 102, where the track zipper assembly 300 is not present to place it in a taut position. As such, the distal ends 708 of the canopy straps 704*a-n* should be coupled to a portion of the vessel 104 away from the end 710, or "distal end" or terminal edge, of the cover 102 to generate that tensional force in a direction away from the fore section 112 of the vessel 104 as exemplified in FIG. 7. The "proximal end" 712 of the cover 102, or the end couplable to the fore section 112 of the marine vessel 104, can also be seen depicted in FIG. 7.

The proximal ends 706 of the canopy straps 704*a-n* are preferably coupled to portion of the cover 102 disposed around or located at the cross bar 204 portion of the support members 200. The canopy straps 704*a-n* can also be seen coupled to each side of the cover 102 as shown in FIG. 1. In some preferred embodiments, the cover 102 utilizes at least three canopy straps 704*a-n*, with one disposed at its proximal end at a location by the cross bar 204, one disposed at its proximal end at a location by the legs 206, 208 of the support members 200, and one disposed at its proximal end at a location from, or attached to, the track zipper assembly 300 and/or the zipper extension 312 (as shown in FIG. 3) to ensure the cover is taut from all principal locations on the cover.

The distal ends 708 are then removably coupled to one or more fasteners, such as a pad eye/pin assembly or a hasp. The canopy straps 704*a-n* may be made of the same material of the cover 102, or may be made of another material sufficient to provide the tensional forces on the cover 102. The cover 102 may also utilize other portions, e.g., portion 712, at its end 710 to facilitate in providing tensional forces upon the cover 102. These portions 712 may also be removably coupled to the marine vessel 104 with one or more fasteners, such as a pad eye/pin assembly or a hasp.

Figure 8:
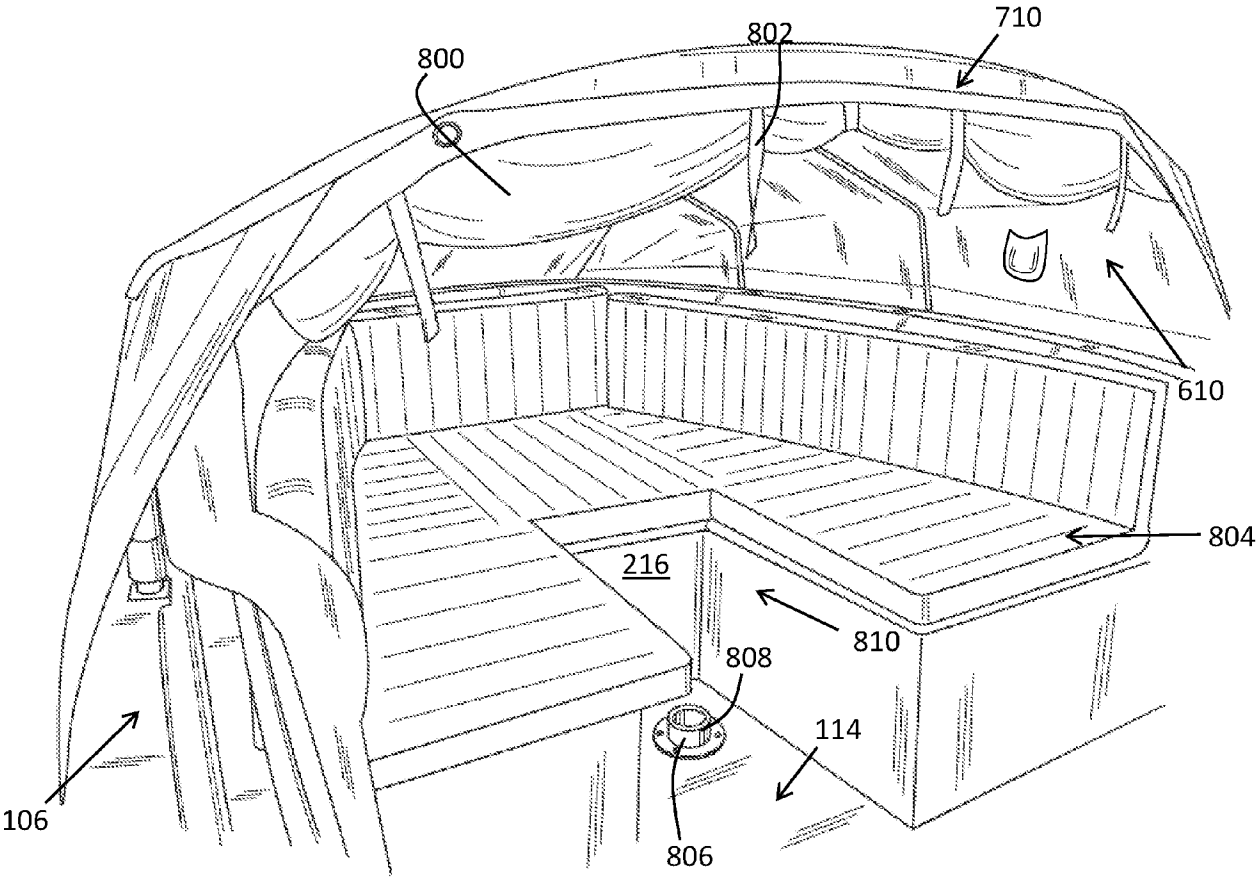
FIG. 8 is a perspective rear view of the removable canopy assembly attached to the vessel in accordance with the present invention.

With reference now to FIG. 8, the cover 102 can be seen at least partially defining an internal volume 216 where users can easily sit or stand in the bow 106. The cover 102 may also have a privacy screen 800 at its end 710 that is operable to be lowered to the upper surface 114 of the vessel and raised depending on the user's desire. The privacy screen 800 may be formed with one or more apertures to permit the influx of air. The privacy screen 800 may also be transparent or translucent to facilitate user visibility there-through. The privacy screen 800 may also be completely enclosed to not permit user visibility, or may have a removable window/door, similar to window 404 in FIG. 4. The privacy screen 800 may be retained in its raised position by one or more straps 802 having snaps coupled thereto; wherein, the snaps are configured to couple to corresponding snaps on the cover 102. As shown in FIG. 8, the cover 102 may also have one or more pockets 812 disposed on the inner surface 610 to provide user storage.

Figure 9:
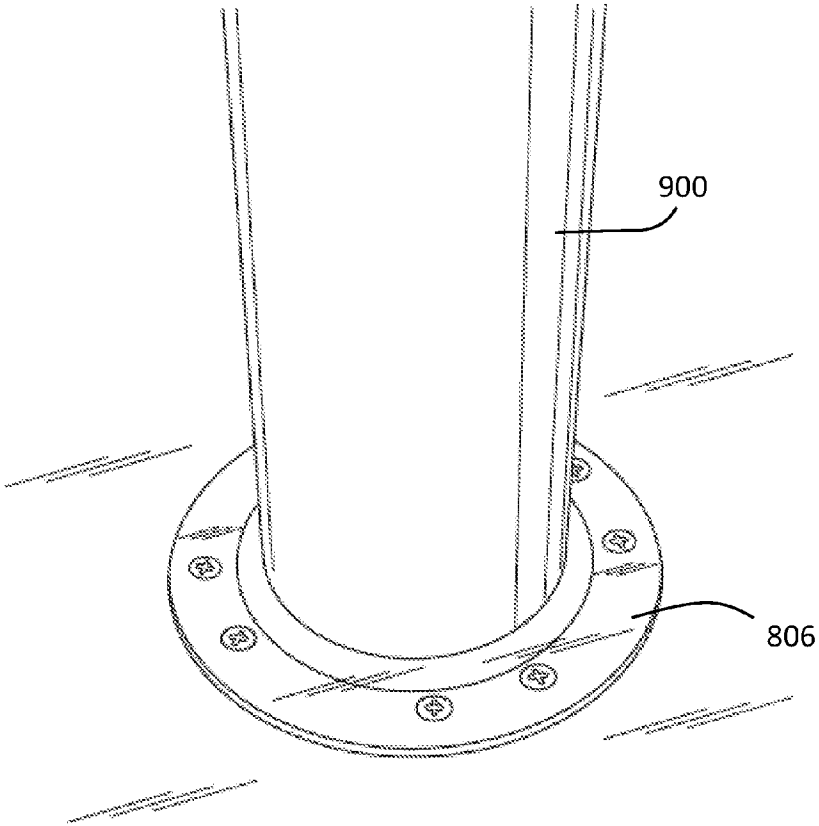
FIG. 9 is a partial, close-up, view of a post shaped to receive an aperture defined by a cylindrical tube in accordance with one embodiment of the present invention.

With reference now to FIGS. 8-9, another advantageous feature of the present invention is depicted, or the ability to convert a lounging or sitting area typically found on many marine vessels into an area with a table. Many marine vessels have a sitting area where cushions or other padding, e.g., padding 804, can be placed. Some marine vessels come with a removable board 226 (as shown in FIG. 2) with padding that is placed in the void 810 between the padding 804. In accordance with one aspect of this additional feature, the upper surface 114 has a post 806 mechanically coupled thereto. The post 806 has a male portion 808 that is shaped to receive an aperture defined by a cylindrical tube 900 as exemplified in FIG. 9. Preferably, the size of the aperture in the tube 900 is slightly greater in diameter, e.g., +/−0.001-0.3" than the male portion 808 of the post 806 to provide a tight fit. The top of the tube 900 includes the board typically used in many marine vessels, except that the board is modified to include the same post/tube configuration described above on the side of the board opposite to side where the cushion is attached. In said manner, the board, with any cushion coupled thereto removed, may be converted into a table for use in the sitting area.

Figure 10:
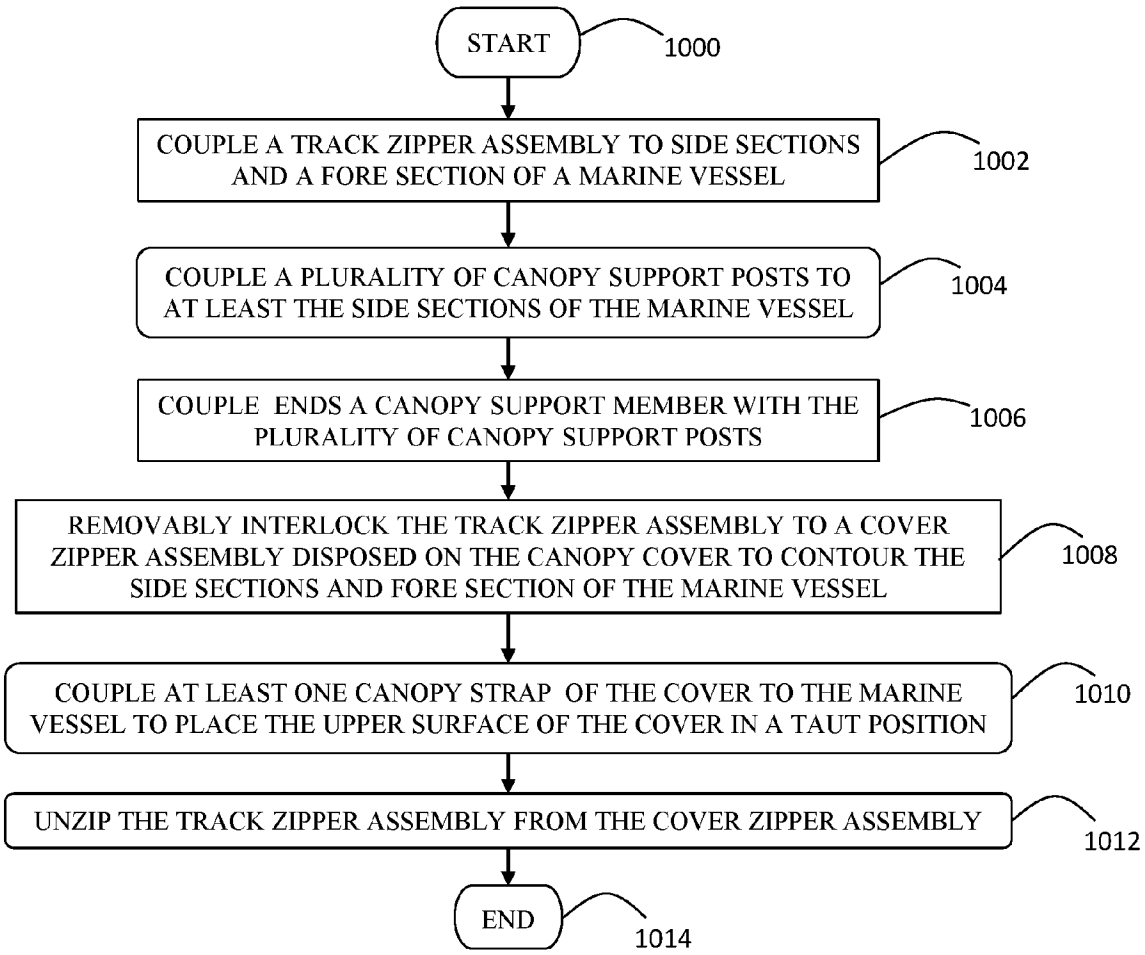
FIG. 10 is a process flow diagram depicting a method of installing and removing a marine vessel canopy assembly in accordance with the present invention.
Figure 11:
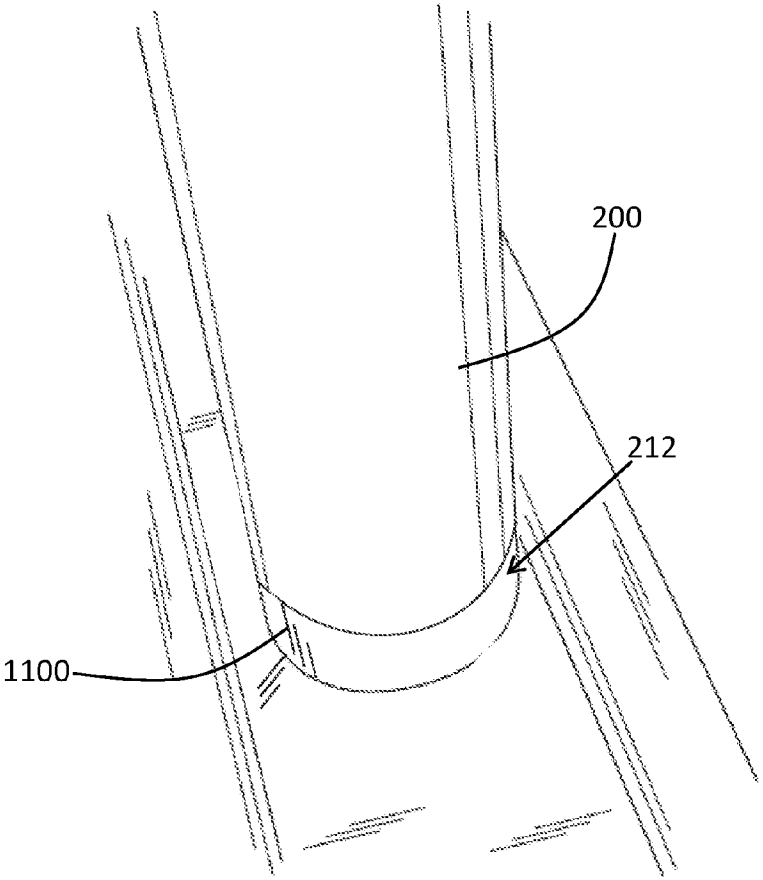
FIG. 11 is a partial, close-up, view of a canopy support member coupled to the marine vessel in accordance with one embodiment of the present invention.

With reference now to FIG. 10, a process flow diagram depicting one exemplary method of installing the aforementioned cover assembly is shown. The process starts at step 1000 and immediately proceeds to step 1002 of coupling a track zipper assembly to the side and fore sections of the marine vessel. This track zipper assembly will be mechanically attached to the marine vessel so that when the cover is removed the track zipper assembly will remain so that user can effectuate an efficient and effective reattachment when desired. The process continues to step 1004 of coupling a plurality of canopy support posts to the side sections of the marine vessel. As discuss above, the support posts may have the cover already coupled thereto. Next, the process continues to step 1006 of coupling the ends of the support posts with a plurality of canopy support posts. This provides lateral resistance to oncoming wind-related forces.

The process continues to step 1008 of removably interlocking, e.g., binding the edges of two pieces of material, the track zipper assembly to a cover zipper assembly disposed on the canopy cover to contour the side sections and the fore section of the marine vessel. This step provides resistance to uplift forces generated by oncoming wind and other elements. Next, step 1010 includes coupling canopy straps of the cover to the marine vessel to place the upper surface of the cover in a taut position. The coupling of the straps protects the cover from forces subjected to it in multiple directions and provides a stable and secure cover when the marine vessel is traveling at high speeds. Lastly, should the user desire to remove the cover, step 1012 includes unzipping the track zipper assembly from the cover zipper assembly to remove the cover and/or the posts from the marine vessel. The user may also have to remove the distal ends of the canopy straps from the marine vessel. As such, the user may then store the cover assembly in an effective and efficient manner. The process then terminates at step 1014.

With reference now to FIGS. 1, 2, 5, and 11, and as discussed above, the ends 212, 214 of the one or more support members 200 are removably coupled to the upper surface 114 without the use of fasteners, e.g., hasps, pins, adhesives, or bolts, so that they can be removed quickly and effectively in an upwardly direction with respect to upper deck surfaces 114 of the respective first and second side sections 108, 110 of the marine vessel when desired. When the canopy 100 is installed, the ends 212, 214 can be described as being maintained or kept in a coupling configuration whether it be by, for example, the post 302 (whereby the ends 212, 214 are adjacent to the upper deck surfaces 114), an aperture formed on the upper deck surfaces 114 of the side sections 108, 110 shaped to receive the ends 212, 214 of the support members 200 (whereby the ends 212, 214 are also adjacent to the upper deck surfaces 114), or using the weight of the canopy/cover itself, e.g., like an adjacent and free-standing configuration of the ends 212, 214 of the one or more support members 200 with respect to the upper deck surfaces 114 of the side sections 108, 110 (as depicted in FIG.

Therefore, when desired by the user, the cover 102 can be placed and kept in a coupling configuration, and quickly and effectively removed in accordance with its intended purpose after unzipped from the track. Said another way, the one or more U-shaped canopy support members 200 are removably coupled to the respective upper deck surfaces 114 of the first and second side sections 108, 110 of the marine vessel without the use of fasteners, including, e.g., bolts, screws, adhesives, hasps, and/or pins, that would otherwise restrict removal of the first and second terminal ends 212, 214 of the canopy support members 200, when the plurality of teeth 306 of the track zipper assembly 300 are unlocked from the plurality of teeth 604 of the cover zipper assembly 602, in an upwardly direction with respect to upper deck surfaces 114 of the respective first and second side sections 108, 110 of the marine vessel. To increase the resistance to horizontal movement, when in the free-standing configuration, the ends 212, 214 of the canopy support members 200 may have a friction-inducting material 1100, such as rubber, disposed thereon. Said differently, the rubber stopper 1100 has a coefficient of friction sufficient to resist horizontal forces of at least approximately 2 lbf.

Figure 13:
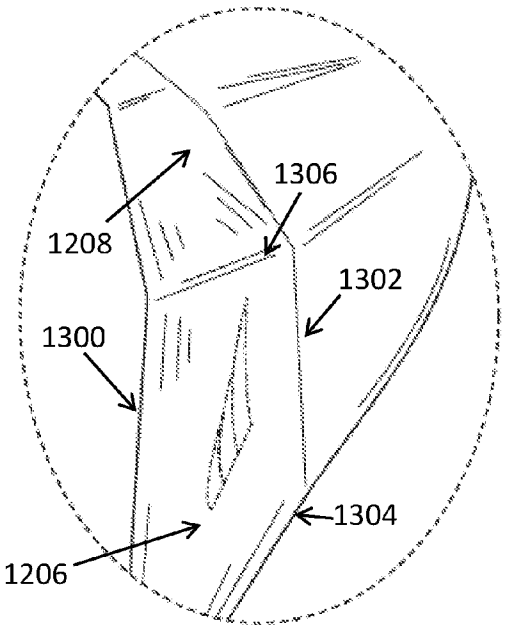
FIG. 13 is a close-up view of the wind deflection portion shown in FIG. 12.
Figure 12:
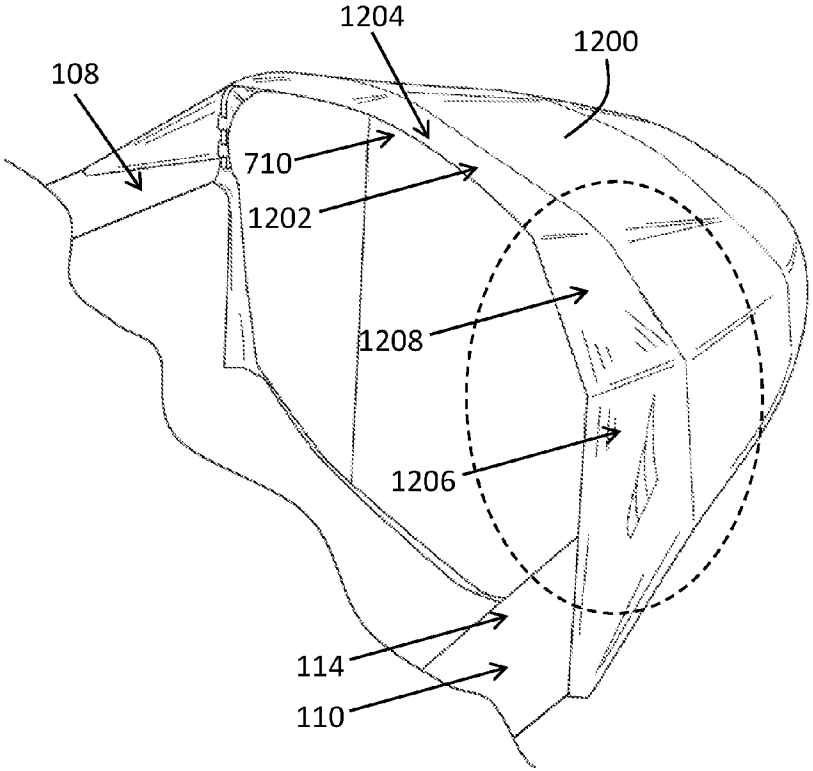
FIG. 12 is a fragmentary perspective, right-side, view of a marine vessel with a removable canopy assembly attached thereto and having a wind deflection portion in accordance with one embodiment of the present invention.
Figure 14:
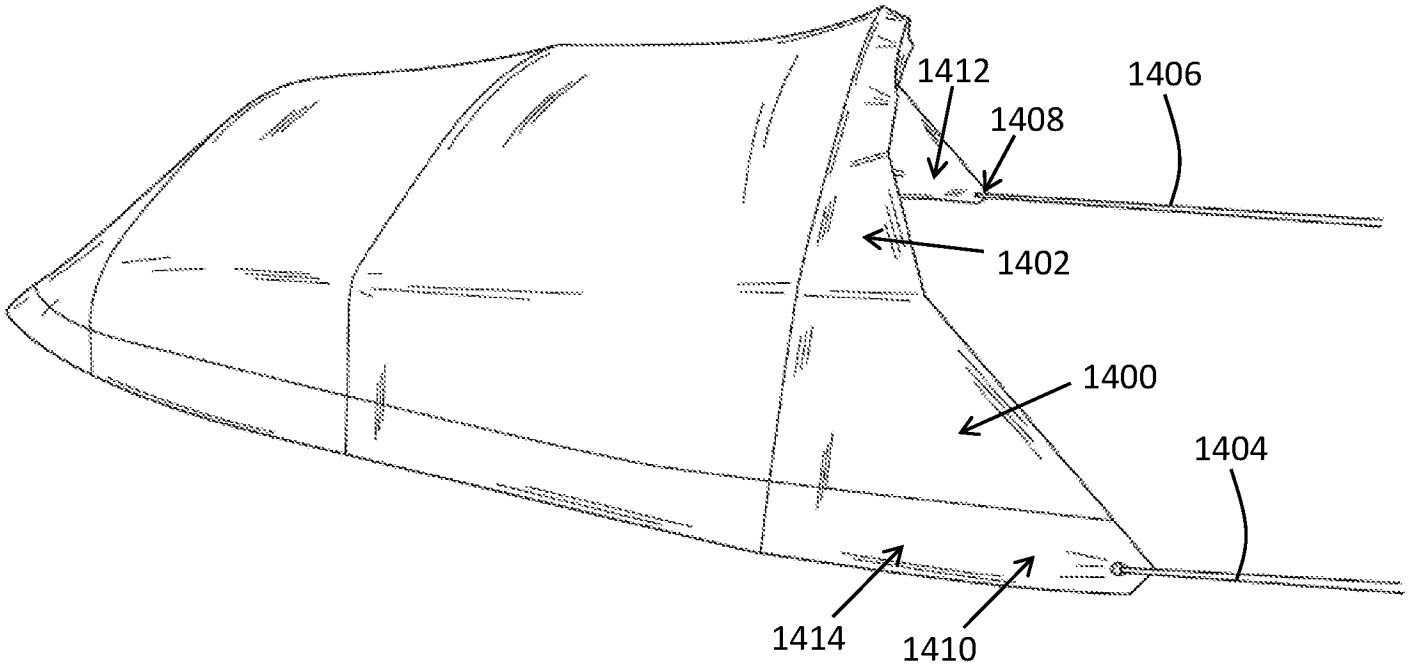
FIG. 14 is a fragmentary perspective, left-side, view of the marine vessel and canopy assembly in FIG. 12.

With reference now to FIGS. 12-14, an exemplary cover 1200 can be seen having a wind deflection portion 1202 spanning from, when coupled to the marine vessel 104, the respective upper deck surfaces 114 of the first and second side sections 108, 110 of the marine vessel 104 and defining a distal end 710 of the cover 1200. The wind deflection portion 1202 includes a horizontal segment 1204 flanked on each side, respectively, by two respective canted and generally planar wind deflection segments 1206, 1208, 1400, 1402. The wind deflection portion 1202 of the cover 1200 beneficially provides users the ability to minimize or eliminate airflow in the area juxtapose to, directly behind, and/or underneath the cover 1200, thereby providing a more comfortable and safe environment for the vessel users. Said differently, the orientation and configuration of the wind deflection portion 1202 generates a laminar airflow profile desired by many boating users.

Specifically, the segments 1206, 1400 extend in an upward direction from the upper surface 114 of the side sections 108, 110 and may be canted inwardly in a multi-directional axis, i.e., such that the distal end 1300 of the section, e.g., section 1206, is angled inwardly with respect to the proximal end 1302 of the section 1206 and the lower end 1304 is angled inwardly with respect to the upper end 1306. Said differently, the segments 1206, 1208, 1400, 1402 may be torsionally oriented to generate the desired airflow profile. Moreover, the second segments 1208, 1402 may be substantially planar (also referred to herein as "planar"), in that they aren't continuously curved (which experiments have demonstrated generates undesired turbulent airflow). The segments 1206, 1208, 1400, 1402 may be sequentially and directly coupled to one another as shown in FIG. 12, may be of a woven and/or non-woven fabric, as described above, and/or may also include one or more rigid inserts disposed therein to facilitate in maintaining rigidity. The inserts may be of a plastic, metallic, or other material. In other embodiments, the segments 1206, 1208, 1400, 1402 may be canted in other orientations and/or directional axes. The thickness of the segments 1206, 1208, 1400, 1402, e.g., spanning from the distal to proximal ends 1300,1302, may range in length from 1-12 inches. Like the other parts of the cover 1200, the segments 1206, 1208, 1400, 1402 are not directly coupled to the side sections 108, 110.

Figure 15:
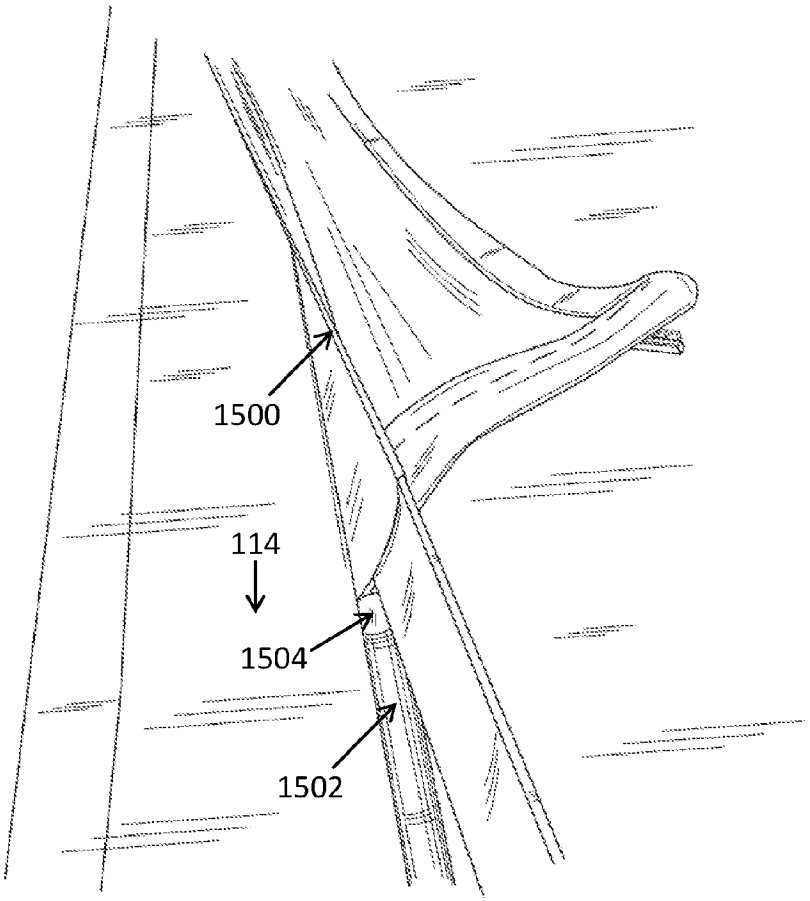
FIG. 15 is a close-up perspective view of a zipper track assembly configuration in accordance with one embodiment of the present invention.

With reference to FIGS. 14-15, the canopy assembly may also include two singular cover straps 1404, 1406. Taking strap 1406 as an example, each of the straps 1404, 1406 include a proximal end 1408 coupled to opposing side portions 1410, 1412 of the track zipper assembly 1414 (as more fully described above). The straps 1404, 1406 also include a distal end 118 coupled to the marine vessel 104 (as best shown in FIG. 1 and as also more fully described above). In other embodiment, the straps 1404, 1406 may be coupled to one or more of the two respective canted and planar wind deflection segments 1206, 1208, 1400, 1402.

With reference now to FIGS. 4 and 14-15, the straps 1404, 1406 may be described "singular" in that experimentation has demonstrated that only the two straps 1404, 1406 are required in order to make the cover taut 102, regardless the bow-width expansion range of the canopy (as more fully described above). For example, and as described above, the canopy support members 200 may be of a flexibly resilient material to increase the canopy support member width 404, when placed in a flexed state, by 10-25%. Said differently, the material of the canopy support members 200 is capable of bending from its static state, i.e., unexposed to an external force, approximately by 10-25% without breaking, yet be capable of returning to its static state without any plastic deformation. In turn, the flexibility of the support members 200 provides users the ability to accommodate various size widths of a hull, thereby providing manufacturers and users the ability to more effectively and efficiently fit more vessels without employing the time- and cost-intensive task of creating a template.

As those of skill in the art will appreciate, however, the cover 1200 may have loose areas or portions generated from differences in bow widths that the canopy assembly is designed to accommodate. These loose areas or portions can be problematic in that they generate an undesired turbulent airflow, decrease aerodynamic efficiency, decrease the aesthetic appearance, and generate additional uplift forces. Therefore, the straps 1404, 1406 enable a user to address or tighten those loose areas or portions caused from differences in bow widths by pulling (and/or adjusting the length of the straps 1404, 1406 using, for example, a buckle) the straps 1404, 1406, thereby making those loose areas or portions taut.

With reference now to FIG. 15, another embodiment of the track zipper assembly 1500 may include an upper surface 114 of the side and fore sections of the marine vessel 104 defining a cylindrical recess 1502 formed at least partially or fully therein, and surrounding said sections. The recess 1502 may be formed as part of the pre-fabrication process of the gunner sections, or may be formed by the user after fabrication. The recess 1502 may be shaped and sized to receive a cylindrical portion 1504 of the track zipper assembly 1500 such that the user inserts the portion 1504 and slides it around the side and fore sections of the marine vessel 104. In other embodiments, the recess 1502 may be positioned with respect to the upper surface 114 such that, when the track assembly 1500 is installed, it is completely recessed within the upper surface 114. Beneficially, the configuration of the recess 1502 increases the structural rigidity of the assembly, in addition to the aesthetic nature of the marine vessel 104 when the canopy assembly is not in use.

With reference now back to FIG. 4, the cover of the canopy assembly also includes a rear portion 406 with three separate panels 408, 404, 410. The three-panel configuration also beneficially facilitates in reducing the generation of loose areas caused by the bow-width expansion of the canopy as described above. Specifically, the panels 408, 404, 410 are longitudinally joined together along joints 412, 414, thereby reducing the collateral bunching of surrounding cover material that ordinarily may have been generated if the rear portion 406 of the cover had been formed in a single-panel configuration. The panels 408, 404, 410 may be joined together using, for example, stitching that may be elastic.

Figure 16:
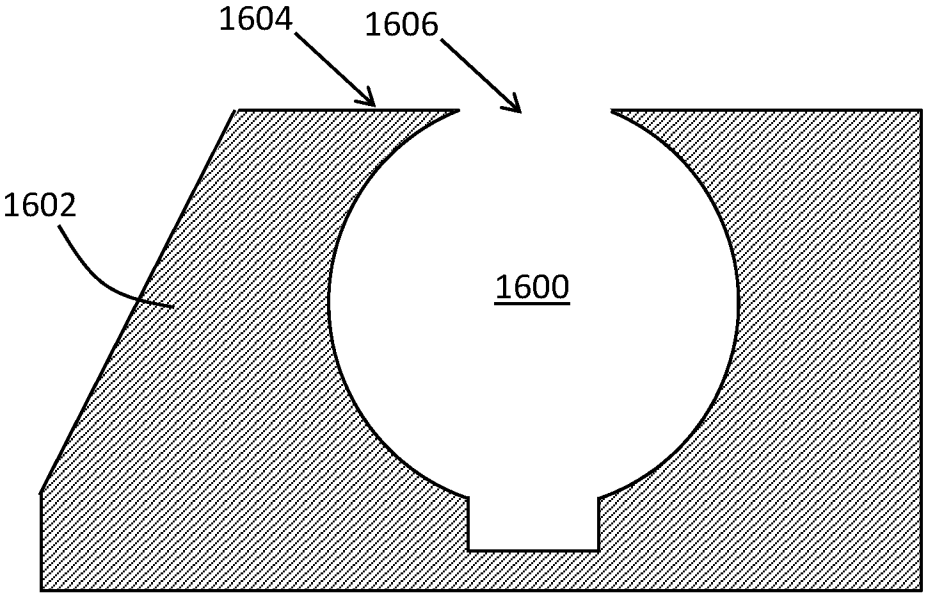
FIG. 16 depicts a close-up cross-sectional view of an exemplary track for receiving the track zipper assembly in accordance with one embodiment of the present invention.

With reference now to FIGS. 15-16, a track 1600, recessed or otherwise, can be seen defining an exemplary channel 1602 shaped and sized to receive, for example, the cylindrical portion 1504 of the track zipper assembly 1500. The track 1600 may also define an upper portion 1604 defining an opening 1606 that permits the fabric or other material of the track zipper assembly 1500 to extend outwardly therefrom. In one embodiment, the diameter of the channel 1602 is slightly larger than the diameter of the cylindrical portion 1504 of the track zipper assembly to create a snug fit.

Figure 17:
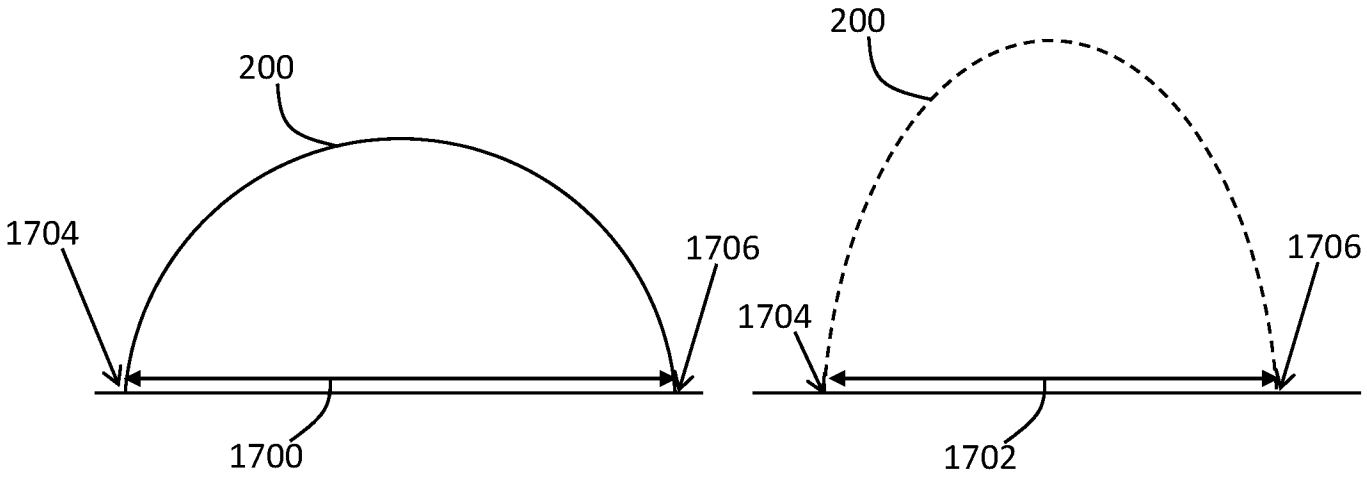
FIG. 17 depicts a representative schematic view of the various widths in which the canopy assembly may accommodate in accordance with the present invention.

With reference now to FIG. 17 and as discussed above, a representative schematic view of the various widths in which the canopy assembly may accommodate is depicted. Said another way, the flexibility and attachment configuration of the support members 200 permits users the ability to accommodate various size widths of a hull, e.g., a first width 1700 and a second width 1702, wherein the first width 1700 is greater than the second width 1702. This accommodation occurs with a single cover and one or more support members 200 having the same length spanning from one end 1704 of the members 200 to another end 1706. Additionally, the flexibility also provides distributors and resellers the ability to accommodate more vessels without employing the time- and cost-intensive task of creating templates. The member 200 to the left in FIG. 17 depicts the member 200 and cover in a first covering position, i.e., to span an exemplary width 1700 of a bow that is approximately 85". The member 200 to the right in FIG. 17 depicts the member 200 and cover in a second covering position, i.e., to span an exemplary width 1702 of a bow that is approximately 75". As also discussed above, the bow-width accommodation variance can cause the cover to sag or become loose in certain areas. To firm out the loose areas of the cover, however, the straps 1404, 1406 (as shown in FIG. 14) can be pulled, thereby making the cover taut.

A marine vessel canopy has been disclosed that provides a novel and effective cover shielding inhabitants or users of the marine vessel from environmental elements that are potentially harmful. The canopy is also configured to resist uplift and other forces generated by wind when the vessel is in a dynamic state. Further, the canopy is operable to be removed quickly and efficiency with minimal user involvement and in little time.

What is claimed is:

1. In combination with a marine vessel having a bow with a first side section including an upper deck surface and a second side section opposing the first side section and including an upper deck surface, a fore section interposing the first and second side sections of the bow, and an upper surface, an improvement comprising:

a canopy assembly having:

at least one U-shaped canopy support member with a first terminal end removably coupled to the upper deck surface of the first side section of the marine vessel in an adjacent and free-standing configuration and a second terminal end removably coupled to the upper deck surface of the second side section of the marine vessel in an adjacent and free-standing configuration;

a cover:

coupled to the at least one U-shaped canopy support members;

with an upper surface providing a water barrier to, and in an overlapping relationship with, the upper surface of the bow of the marine vessel;

spanning from the first and second ends of each of the at least one U-shaped canopy support members; and having a cover zipper assembly with a plurality of teeth; and a track zipper assembly mechanically coupled to the first and second side sections and the fore section of the marine vessel, the track zipper assembly having a plurality of teeth removably interlocked with the plurality of teeth of the cover zipper assembly to form a joint that contours a portion of the marine vessel that includes the first and second side sections and the fore section of the marine vessel, the first and second terminal ends of the at least one U-shaped canopy support member are removably coupled to the respective upper deck surfaces of the first and second side sections of the marine vessel without the use of fasteners, including bolts, screws, and adhesives, that would otherwise restrict removal of the first and second terminal ends of the at least one U-shaped canopy support member, when the plurality of teeth of the track zipper assembly are unlocked from the plurality of teeth of the cover zipper assembly, in an upwardly direction with respect to upper deck surfaces of the respective first and second side sections of the marine vessel, whereby the cover and the at least one U-shaped canopy support member can be uncoupled from marine vessel through unlocking the plurality of teeth of the track zipper assembly from the plurality of teeth of the cover zipper.

2. The improvement according to claim 1, wherein:

the plurality of teeth of the track zipper assembly are operably configured to be removably interlocked with the plurality of teeth of the cover zipper assembly in single substantially uninterrupted motion.

3. The improvement according to claim 1, further comprising:

at least one canopy strap with a proximal end coupled to the cover of the canopy assembly, the at least one canopy strap having an installed position with a distal end coupled to the marine vessel to place the upper surface in a taut position.

4. The improvement according to claim 1, wherein the at least one U-shaped canopy support member further comprises:

a cross bar removably coupleable to a first leg having the first end and to a second leg having the second end.

5. The improvement according to claim 1, wherein:

the cross bar is arcuate.

6. The improvement according to claim 1, wherein the canopy assembly further comprises:

at least two U-shaped canopy support members each with a first terminal end removably coupled to the upper deck surface of the first side section of the marine vessel in an adjacent and free-standing configuration and a second terminal end removably coupled to the upper deck surface of the second side section of the marine vessel in an adjacent and free-standing configuration.

7. The improvement according to claim 6, wherein the first and second ends of each of the at least two U-shaped canopy support members further comprise:

a canopy support member width when the at least two U-shaped canopy support members are in a static state, wherein the at least two U-shaped canopy support members are of a flexibly resilient material to increase the canopy support member width, when in the static state, by 10-25% when placed in a flexed state.

8. The improvement according to claim 1, wherein the upper surface of the cover further comprises:

a flap portion sized and configured to overlap the joint, leaving the joint not visible from an outside ambient environment.

9. The improvement according to claim 1, wherein the cover further comprises:

a wind deflection portion spanning from the respective upper deck surfaces of the first and second side sections of the marine vessel and defining a distal end of the cover, the wind deflection portion having, when the first and second terminal ends of the at least one U-shaped canopy support member are removably coupled to the respective upper deck surfaces of the first and second side sections of the marine vessel, a horizontal segment flanked on each side, respectively, by two respective canted and generally planar wind deflection segments.

10. The improvement according to claim 1, further comprising:

a rubber material disposed at the first and second terminal ends of the at least one U-shaped canopy support member.

11. In combination with a marine vessel having a bow with a first side section including an upper deck surface and a second side section opposing the first side section and including an upper deck surface, a fore section interposing the first and second side sections of the bow, and an upper surface; an improvement comprising:

a canopy assembly having:

at least one U-shaped canopy support member with a first terminal end removably coupled to the upper deck surface of the first side section of the marine vessel and a second terminal end removably coupled to the upper deck surface of the second side section of the marine vessel;

a cover:

coupled to the at least one U-shaped canopy support members;

with an upper surface providing a water barrier to, and in an overlapping relationship with, the upper surface of the bow of the marine vessel;

spanning from the first and second ends of each of the at least one U-shaped canopy support members;

having a cover zipper assembly with a plurality of teeth; and having a wind deflection portion spanning from the respective upper deck surfaces of the first and second side sections of the marine vessel and defining a distal end of the cover, the wind deflection portion having, when the first and second terminal ends of the at least one U-shaped canopy support member are removably coupled to the respective upper deck surfaces of the first and second side sections of the marine vessel, a horizontal segment flanked on each side, respectively, by two respective canted and generally planar wind deflection segments; and a track zipper assembly mechanically coupled to the first and second side sections and the fore section of the marine vessel, the track zipper assembly having a plurality of teeth removably interlocked with the plurality of teeth of the cover zipper assembly to form a joint that contours a portion of the marine vessel that includes the first and second side sections and the fore section of the marine vessel.

12. The improvement according to claim 11, wherein:

the first and second terminal ends of the at least one U-shaped canopy support member are removably coupled to the respective upper deck surfaces of the first and second side sections of the marine vessel without the use of fasteners, including bolts, screws, and adhesives, that would otherwise restrict removal of the first and second terminal ends of the at least one U-shaped canopy support members, when the plurality of teeth of the track zipper assembly are unlocked from the plurality of teeth of the cover zipper assembly, in an upwardly direction with respect to upper deck surfaces of the respective first and second side sections of the marine vessel, whereby the cover and the at least one U-shaped canopy support members can be uncoupled from marine vessel through unlocking the plurality of teeth of the track zipper assembly from the plurality of teeth of the cover zipper.

13. The improvement according to claim 11, wherein:

the first and second terminal ends of the at least one U-shaped canopy support member are removably coupled to the upper deck surface of the first and second side sections, respectively, of the marine vessel in an adjacent and free-standing configuration.

14. The improvement according to claim 11, wherein:

each of the two respective canted and planar wind deflection segments are sequentially and directly coupled to one another.

15. The improvement according to claim 11, further comprising:

two singular cover straps, each with a proximal end coupled to opposing side portions of the track zipper assembly and with a distal end coupled to the marine vessel.

16. In combination with a marine vessel having a bow with a first side section including an upper deck surface and a second side section opposing the first side section and including an upper deck surface, a fore section interposing the first and second side sections of the bow, and an upper surface, an improvement comprising:

a canopy assembly having:

a canopy support member with a first terminal end removably and adjacently directly coupled and retained to the upper deck surface of the first side section of the marine vessel and a second terminal end removably and adjacently directly coupled and retained to the upper deck surface of the second side section of the marine vessel;

a cover:

coupled to the canopy support member;

with an upper surface providing a water harrier to, and in an overlapping relationship with, the upper surface of the how of the marine vessel;

spanning from the first and second ends of each of the canopy support member; and having a cover zipper assembly with a plurality of teeth; and a track zipper assembly coupled to the first and second side sections and the fore section of the marine vessel, the track zipper assembly having a plurality of teeth removably interlocked with the plurality of teeth of the cover zipper assembly to form a joint that contours a portion of the marine vessel that includes the first and second side sections and the fore section of the marine vessel, the first and second terminal ends of the canopy support member are removably coupled and retained to the respective upper deck surfaces of the first and second side sections of the marine vessel without the use of fasteners, including bolts, screws, adhesives, hasps, and pins, that would otherwise restrict removal of the first and second terminal ends of the canopy support member, when removably coupled to the respective first and second side sections of the marine vessel, in an upwardly direction with respect to upper deck surfaces of the respective first and second side sections of the marine vessel, whereby the cover and the canopy support member can be uncoupled from marine vessel through unlocking the plurality of teeth of the track zipper assembly from the plurality of teeth of the cover zipper.

17. The improvement according to claim 16, wherein at least one of the track zipper assembly and cover zipper assembly further comprising:

a handle operably configured to unlock the plurality of teeth of the track zipper assembly from the plurality of teeth of the cover zipper spanning the joint while the handle is disposed within an interior volume at least partially defined by an inner surface the cover.

18. In combination with a marine vessel having a bow with a first side section including an upper deck surface and a second side section opposing the first side section and including an upper deck surface, a fore section interposing the first and second side sections of the how, and an upper surface, an improvement comprising:

a canopy assembly adapted to span various how widths and having:

a canopy support member with a first terminal end removably and adjacently directly coupled to the upper deck surface of the first side section of the marine vessel in an adjacent and free-standing configuration permitting horizontal movement and a second terminal end removably and adjacently directly coupled to the upper deck surface of the second side section of the marine vessel in an adjacent and free-standing configuration permitting horizontal movement; and a cover:

coupled to the canopy support member through at least one loop defining an aperture with the canopy support member disposed therein;

with an upper surface providing a water barrier to, and in an overlapping relationship with, the upper surface of the bow of the marine vessel;

spanning from the first and second ends of the canopy support member; and with a lower end coupled to, and contouring, the first side section, the fore section, and the second side section of the bow;

the first and second terminal ends of the canopy support member are removably coupled and retained to the respective upper deck surfaces of the first and second side sections of the marine vessel without the use of fasteners, including bolts, screws, adhesives, hasps, and pins, that would otherwise restrict removal of the first and second terminal ends of the canopy support member, when removably coupled to the respective first and second side sections of the marine vessel, in an upwardly direction with respect to upper deck surfaces of the respective first and second side sections of the marine vessel, whereby the cover and the canopy support member can be uncoupled from marine vessel through uncoupling the lower end of the cover from the first side section, the fore section, and the second side section of the bow; and the cover operably configured to have a first covering position with a first width separating the first and second terminal ends when removably and adjacently directly coupled to the upper deck surfaces of the first and second side sections, respectively, and a second covering position with a second width separating the first and second terminal ends separating the first and second terminal ends when removably and adjacently directly coupled to the upper deck surfaces of the first and second side sections, respectively, the second width of a length greater than the first width and the second position including a plurality of straps placed in greater tension than when the cover is in the second position.

19. The improvement according to claim 18, further comprising:

the plurality of straps with a proximal end disposed at and coupled to respective opposing side portions of the cover and with a distal end disposed at and coupled to respective first and second side sections of the bow.

* * * * *